US010654085B2

(12) United States Patent
De Giorgio et al.

(10) Patent No.: US 10,654,085 B2
(45) Date of Patent: May 19, 2020

(54) APPARATUS AND METHOD TO GUIDE METAL PRODUCTS

(71) Applicant: DANIELI & C. OFFICINE MECCANICHE SPA, Buttrio (IT)

(72) Inventors: Tiziano De Giorgio, Udine (IT); Massimo Zanco, Lovaria di Pradamano (IT)

(73) Assignee: DANIELI & C. OFFICINE MECCANICHE S.P.A., Buttrio (IT)

( * ) Notice: Subject to any disclaimer, the term of this patent is extended or adjusted under 35 U.S.C. 154(b) by 0 days.

(21) Appl. No.: 16/496,077

(22) PCT Filed: Apr. 27, 2018

(86) PCT No.: PCT/IT2018/050079
§ 371 (c)(1),
(2) Date: Sep. 20, 2019

(87) PCT Pub. No.: WO2018/203359
PCT Pub. Date: Nov. 8, 2018

(65) Prior Publication Data

US 2020/0047229 A1 Feb. 13, 2020

(30) Foreign Application Priority Data

May 4, 2017 (IT) ..... 102017000048436

(51) Int. Cl.

| | |
|---|---|
| ***B21B 39/16*** | (2006.01) |
| ***B65H 57/06*** | (2006.01) |
| ***B65H 57/14*** | (2006.01) |
| ***B65H 57/26*** | (2006.01) |

(52) U.S. Cl.
CPC ..... *B21B 39/165* (2013.01); *B65H 57/06* (2013.01); *B65H 57/14* (2013.01); *B65H 57/26* (2013.01)

(58) Field of Classification Search
CPC ..... B65H 57/06; B65H 57/14; B65H 57/26; B21B 39/165
See application file for complete search history.

(56) References Cited

U.S. PATENT DOCUMENTS 4,790,164 A 12/1988 Rothe

FOREIGN PATENT DOCUMENTS

| | | |
|---|---|---|
| JP | 2015231636 A | 12/2015 |
| WO | 0066288 A1 | 11/2000 |

OTHER PUBLICATIONS

Int'l Search Report dated Feb. 7, 2018 in Int'l Application No. PCT/IT2018/050079.
Int'l Preliminary Report on Patentability dated Oct. 4, 2018 in Int'l Application No. PCT/IT2018/050079.

*Primary Examiner* — William E Dondero
(74) *Attorney, Agent, or Firm* — Panitch Schwarze Belisario & Nadel LLP

(57) ABSTRACT

Apparatus to guide a metal product, the apparatus includes a support body (11). A plurality of support arms (12) are associated with the support body (11). A plurality of guide rolls (13) are installed rotating in an idle manner on the support arms (12) and define between them a roller guide gap (14) for the metal product. Adjustment devices (24) associated with the support arms (12) and adjust, independently from each other, the position of each of the guide rolls (13. Detection devices (19) detect the stresses induced by the metal product on the guide rolls (13).

9 Claims, 5 Drawing Sheets

APPARATUS AND METHOD TO GUIDE METAL PRODUCTS

CROSS-REFERENCE TO RELATED APPLICATIONS

This application is a Section 371 of International Application No. PCT/IT2018/050079, filed Apr. 27, 2018, which was published in the English language on Nov. 8, 2018, under International Publication No. WO 2018/203359 A1, which claims priority under 35 U.S.C. § 119(b) to Italian Application No. 102017000048436, filed May 4, 2017, the disclosures of each of which are incorporated herein by reference.

FIELD OF THE INVENTION

The present invention concerns a guide apparatus, applicable in the field of rolling long metal products, to guide and support the metal products entering, or exiting from, a rolling apparatus for the metal products.

In particular, with the guide apparatus it is possible to process long metal products, such as bars, or very large profiles, although the application to round pieces and/or rods is not excluded.

The present invention also concerns a rolling machine comprising at least one guide apparatus and a rolling apparatus.

The present invention also concerns the corresponding method to guide metal products.

BACKGROUND OF THE INVENTION

The rolling of long metal products provides the progressive reduction of the thickness of the metal products by means of cylinders, rolls, or rotating rings of rolling apparatuses or stands along which the metal product is fed and rolled.

It is known to use, for example in the final steps of the rolling process, one or more guide apparatuses, also called roller guides, each configured to guide and support the metal products entering or leaving the rolling apparatus, for example a finishing stand.

Known guide apparatuses each comprise at least one pair of guide rolls mounted idle on a support body and having axes of rotation orthogonal to a rolling axis.

Examples of guide apparatuses provided with two guide rolls are described in documents U.S. Pat. No. 4,790,164, WO-A-00/66288 and JP-A-2015/231636.

In particular, U.S. Pat. No. 4,790,164 describes a guide apparatus provided with a sensor for each guide roll. In U.S. Pat. No. 4,790,164 it is claimed that only one sensor could be sufficient, given that the two guide rolls are disposed so that the pressure loads are equal to each other. The output pressure signal, or each output pressure signal, detected by the sensor can be fed to an indication or recording mean, to adjust the guide rolls by adjustment screws.

U.S. Pat. No. 4,790,164 also describes that it is also possible to provide the output signal of the sensor or sensors, to a drive for the adjustment of the guide rolls or their support arms, in order to maintain the original pressure of the guide rolls constant on the material passing through them. The presence of a single drive for both adjustment screws allows a substantially symmetrical adjustment of the loads acting on the guide rolls, precisely because of their disposition as described above.

Moreover, U.S. Pat. No. 4,790,164 provides, in another embodiment thereof, that the support arms are each provided with a horizontal adjustment screw and a clamping screw to clamp the adjustment screw. The presence of a clamping screw, however, does not allow to associate with the adjustment screws a drive to remotely automate the adjustment of the roller guide gap of the metal product, since the rotation of the adjustment screw is prevented by the clamping screw.

The guide apparatus described in WO-A-00/66288 comprises a support structure, a pair of support arms with an oblong development pivoted in their centerline and to the support structure, and guide rolls installed at one end of the support arms. The support arms comprise, at the opposite end with respect to that where the guide rolls are installed, adjustment screws to adjust the passage gap between the two guide rolls.

A force detector is also associated with each support atm, provided to detect the forces acting on each guide roll.

The guide apparatus described in WO-A-00/66288 also comprises a single adjustment device, which can also be motorized, to adjust the size of the passage gap between the guide rolls.

The single adjustment device allows to adjust the position of both support arms of the guide rolls in a synchronized and conjoint manner.

JP-A-2015/231636 describes another guide apparatus which comprises a pair of guide rolls each of which is installed on a respective rotation pin attached to a support structure of the guide apparatus.

On each rotation pin, a respective toothed wheel is installed, integrally and eccentrically.

The toothed wheels both engage on a single toothed rack which is moved linearly, determining a consequent rotation of the toothed wheels. The rotation of the toothed wheels determines a consequent eccentric rotation of the rotation pins, obtaining an adjustment of the passage gap of the metal product. The linear movement of the rack is determined by a hydraulic piston. This adjustment mode, however, is not precise and adjusts the position of both support arms.

In the rolling of metal products, for example with a diameter comprised between 4 and 170 mm or more, and where rather narrow dimensional tolerances are required, the use of guide apparatuses is also known, associated with the rolling apparatuses and having three, four or more guide rolls installed on support arms, in turn associated with a support body.

It is also known that rolling apparatuses are also configured to exert quite high compression actions on the metal product, for example by means of three, four or more rolling rolls, and that the section of the metal product exiting from a rolling stand can also have a non-regular shape and size, for example ovalized, diamond-shaped, and therefore not round. For this purpose the guide rolls of the guide apparatus are also disposed so as to define between them a roller guide gap of a shape and size suitable for those of the metal product that is to be guided.

It is also known that the guide apparatus must be installed in such a way that the roller guide gap between the guide rolls is aligned with the axis, that is, with the rolling channel of the rolling apparatus. This allows to feed and guide the metal product correctly toward the rolling apparatus.

An unaligned feed of the metal products with respect to the rolling apparatus determines an incorrect rolling of the metal product and therefore does not respect the dimensional and/or geometric tolerances of the product; it also determines a production of non-linear rolled products which, due to their distortion, must be discarded.

The misalignment of the guide apparatus with respect to the rolling apparatus, moreover, causes the onset of different stresses on the guide rolls, with consequent non-uniform wear of one guide roll with respect to the other.

Moreover, the different stresses between the two guide rolls are also transferred to the components connected to them, for example to the support bearings of the guide rolls, with a consequent reduction in their working life.

It is known that, at present, the alignment between the roller guide gap of the guide rolls and the rolling axis of the rolling apparatus is carried out on the bench, that is, with the guide apparatus not installed on the rolling machine.

Alignment is carried out using a calibration apparatus that simulates the passage of a product to be rolled and the position of the guide rolls is adjusted as a function of this.

However, even if the calibration can be carried out with care and the elements that attach the guide apparatus to the rolling machine comply with very strict tolerances, the alignment of the guide apparatus, once installed in the rolling machine, will always deviate from the alignment defined in the calibration step. This also in relation to deformations and/or settling to which the different components of the guide apparatus are subject.

Guide apparatuses are also known, provided with detection devices, for example load cells, strain gauges, or other detection devices, for example based on the Wheatstone bridge principle, which are associated with support arms of the guide rolls and configured to detect the stresses to which the latter are subjected during use. Depending on the data detected by the detection devices, the amplitude of the roller guide gap and/or the position of the entire guide apparatus with respect to the rolling machine is adjusted.

This manufacturing solution, however, does not allow to obtain a correct calibration, and leads to the generation of metal products that do not meet the quality requirements.

Furthermore, this type of guide apparatus cannot be adopted for large-sized metal products.

For large-sized metal products, where very strict tolerances are normally required, it is in fact required that the guide rolls exert an action to contain the metal product and, therefore, the use of guide apparatuses with three, normally four guide rolls is often required, which are installed on a common support body and located on the periphery of the metal product to exert a correct guide action.

In this case, a movement of the entire support body cannot solve the problems of alignment of the roller guide gap with the rolling gap, for example due to the fact that one or more of the guide rolls are not positioned correctly and therefore, they interfere with the movement of the metal product, or do not exert a guide and holding action.

Moreover, during the work cycles, the support bodies are subject to mechanical and/or thermal expansion, also variable depending on the material of which they are made, which determine further interference in the guide action.

In these solutions, therefore, the guide apparatus must be removed from the rolling machine to perform an additional calibration.

To this must also be added the fact that the manual adjustment members of the guide rolls cannot be accessed by the operators when they are installed on board the rolling machine.

Moreover, during the rolling process, the rolling rolls are subject to rather considerable processes of wear which lead to the production of increasingly large products.

The increase in size of the metal product also induces further stresses on the guide rolls, with consequent wear.

One purpose of the present invention is to provide a guide apparatus which allows to feed, in a precise, controlled and aligned manner the metal products in a rolling apparatus.

Another purpose of the present invention is to provide a guide apparatus for metal products which allows to adjust the shape and size of the roller guide gap defined between the guide rolls.

Another purpose of the present invention is to provide a guide apparatus which allows to adjust the position of the guide rolls at any time, even with the guide apparatus installed in the rolling machine, or during rolling.

Another purpose of the present invention is to provide a guide apparatus which allows to obtain high quality metal products, that is, which satisfy the desired requirements of dimensional and/or geometrical tolerance.

Another purpose of the present invention is to provide a guide apparatus which allows to increase the working life of the components, or parts of them, by reducing maintenance operations.

Another purpose of the present invention is to perfect a method to guide metal products which allows to adjust the shape and size of the roller guide gap defined between the guide rolls, at any time, even with the guide apparatus installed on a rolling machine and/or during use.

Another purpose of the present invention is to perfect a method to guide metal products which allows to obtain high-quality metal products, and which allows to increase the working life of the components of the guide apparatus.

The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe other characteristics of the invention or variants to the main inventive idea.

In accordance with the above purposes, the present invention concerns an apparatus to guide the introduction and/or discharge of a metal product, in or from a rolling apparatus.

The guide apparatus comprises a support body, a plurality of support arms, also called in the specific field roll holder levers, associated with the support body, and a plurality of guide rolls, or little rolls, installed rotating in an idle manner on the support arms and defining between them a roller guide gap for the metal product.

In accordance with another aspect of the present invention, a respective adjustment device is associated with each support arm and configured to adjust, independently from the other adjustment devices, the position of each of the guide rolls.

Moreover, in accordance with some embodiments of the present invention, the guide apparatus comprises detection devices configured to detect the stresses induced by the metal product on each guide roll.

According to one aspect of the present invention, each adjustment device comprises its own drive member to adjust the position of the support arms and therefore of each guide roll.

In accordance with another aspect of the present invention, the guide apparatus comprises a control and command unit connected to the detection devices and to the drive members, and configured to command the drive of the latter as a function of data detected by the detection devices.

In this way, each support arm can be adjusted independently of the other support arms, allowing a targeted and precise adjustment of the shape and size of the roller guide gap defined by the guide rolls. The adjustment can also be made after an initial calibration, and for example, can be made directly with the guide apparatus installed on the rolling apparatus. The presence of a drive member for each adjustment device also allows to compensate for any possible non-alignments of the roller guide axis and the rolling axis that might occur following the installation of the guide apparatus on the rolling apparatus. Moreover, the independent actuation of the drive members also allows to compensate any possible defects and/or mechanical plays present between the support arms and the support body and that might generate a non-symmetrical positioning condition of the guide rolls with respect to the roller guide axis. The presence of drive members also allows to adjust the position of each guide roll even from a distance, that is, without the direct intervention of the operators on the adjustment devices. Each drive member, being distinct for each guide roll, allows to adjust the position of the respective guide roll independently from the other drive members.

The present invention also concerns a method to guide a metal product exiting from or entering into a rolling apparatus, which provides to make the metal product pass through a roller guide gap defined by guide rolls installed, rotating in idle manner, on support arms, said support arms being associated with a support body. The method also comprises the adjustment of the position of each of the guide rolls, independently from each other, with adjustment devices each associated with one of the support arms and the detection, with detection devices, each associated with one of the support arms, of the stresses induced by the metal product on the guide rolls.

Moreover, the method provides that each adjustment device is driven by its own drive member to adjust the position of each of the guide rolls. The drive of the drive members is commanded by a control and command unit that detects the data from the detection devices and commands the drive members as a function of these.

BRIEF DESCRIPTION OF THE DRAWINGS

These and other characteristics of the present invention will become apparent from the following description of some embodiments, given as a non-restrictive example with reference to the attached drawings wherein.

To facilitate comprehension, the same reference numbers have been used, where possible, to identify identical common elements in the drawings. It is understood that elements and characteristics of one embodiment can conveniently be incorporated into other embodiments without further clarifications.

DETAILED DESCRIPTION OF SOME EMBODIMENTS

Figure 1:
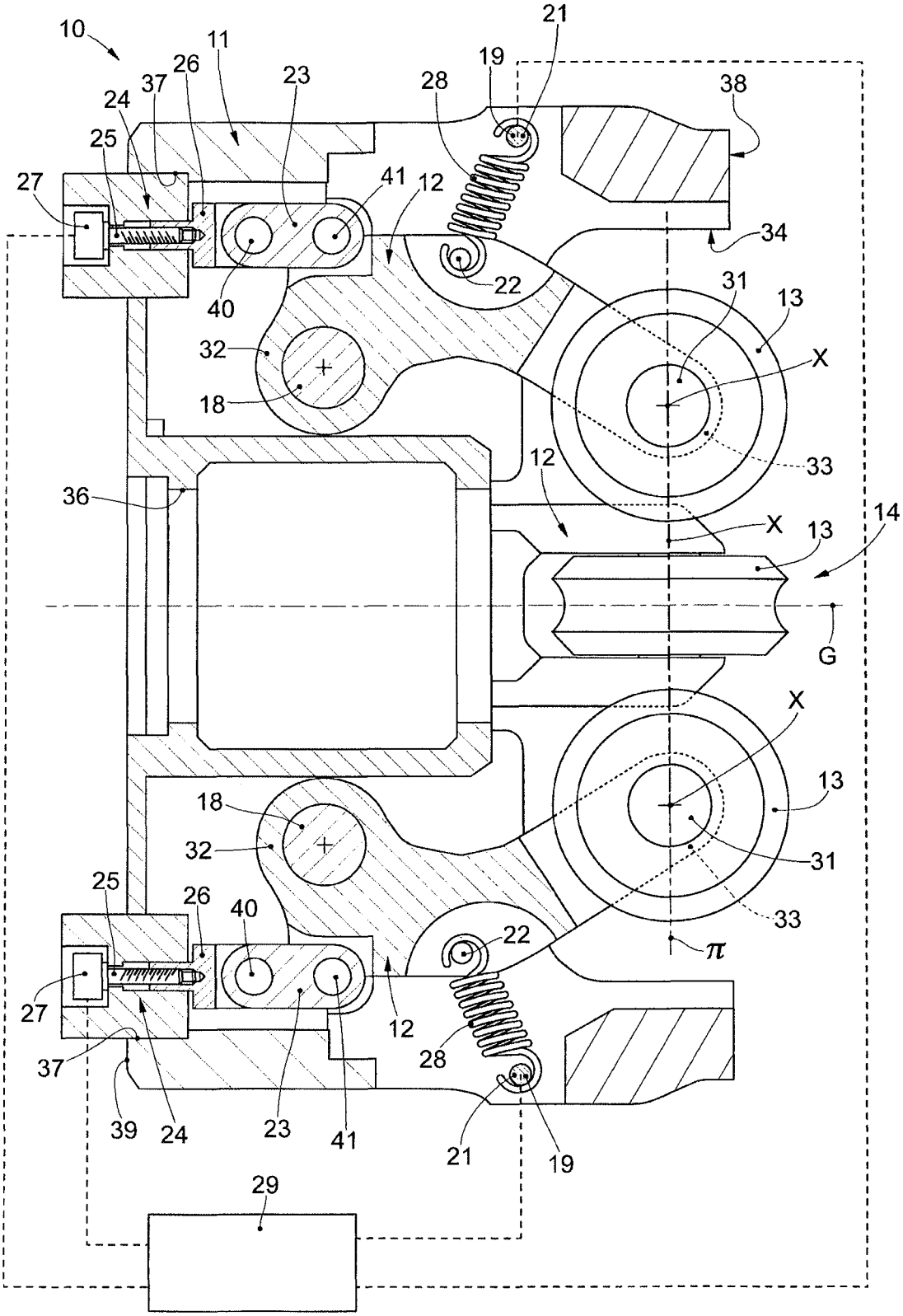
FIG. 1 is a section view of a guide apparatus according to one embodiment.

We will now refer in detail to the various embodiments of the present invention, of which one or more examples are shown in the attached drawings. Each example is supplied by way of illustration of the invention and shall not be understood as a limitation thereof. For example, the characteristics shown or described insomuch as they are part of one embodiment can be adopted on, or in association with, other embodiments to produce another embodiment. It is understood that the present invention shall include all such modifications and variants.

Embodiments described here using FIGS. 1 to 5, refer to a guide apparatus 10 which can be installed downstream and/or upstream of a rolling apparatus 110 (FIG. 2), respectively to guide the introduction and/or discharge of a metal product.

The metal products can be selected from a group comprising bars, profiles, round pieces, rod, or other similar products.

The present invention also concerns a rolling machine 100 (FIG. 2) which comprises at least one rolling apparatus 110 and at least one guide apparatus 10 installed on said rolling apparatus 110.

The guide apparatus 10 comprises a support body 11 and a plurality of support arms or roll holder levers 12, associated with the support body 11.

In particular, according to a possible solution (FIGS. 1-4), the support arms 12 are pivoted to the support body 11 by means of pivoting elements 18, for example pins.

Figure 5:
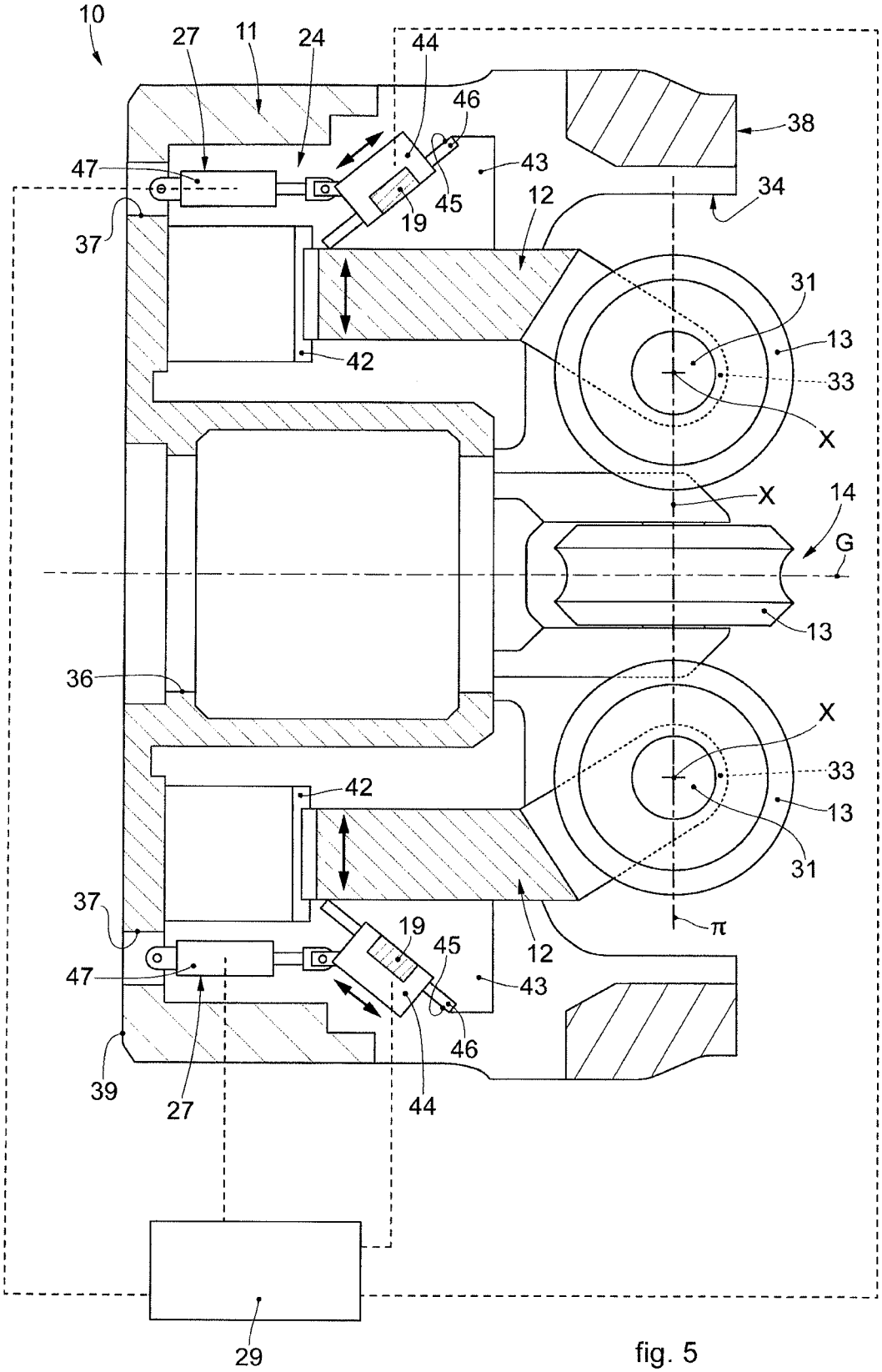
FIG. 5 is a section view of a guide apparatus according to another embodiment.

According to another variant embodiment, shown by way of example in FIG. 5, each support arm 12 can be installed slidably with respect to the support body 11 on a respective sliding guide 42 associated with the support body 11.

The support arms 12 can be installed protruding cantilevered toward a first side 38 of the support body 11.

The support body 11 can be provided with a second side 39, opposite the first side 38, and configured to allow to connect the support body 11 to the rolling apparatus 110, as described below.

According to one aspect of the present invention, the guide apparatus 10 comprises a plurality of guide rolls, or little rolls 13, installed rotating idly on the support arms 12 and defining a roller guide gap 14 between them for the passage of the metal product.

The movement of the support arms 12 with respect to the support body 11, for example a rotation around the pivoting elements 18, or a translation along the sliding guides 42, allows to adjust the sizes of the roller guide gap 14.

The roller guide gap 14 in turn defines a roller guide axis G, along which, during use, the metal product is guided and made to advance.

The guide rolls 13 are positioned, during use, on the periphery of the metal product to exert a desired containing and guide action on the latter.

The guide rolls 13 can all have the same size, so as to exert the same guide stresses on the metal product.

Figure 2:
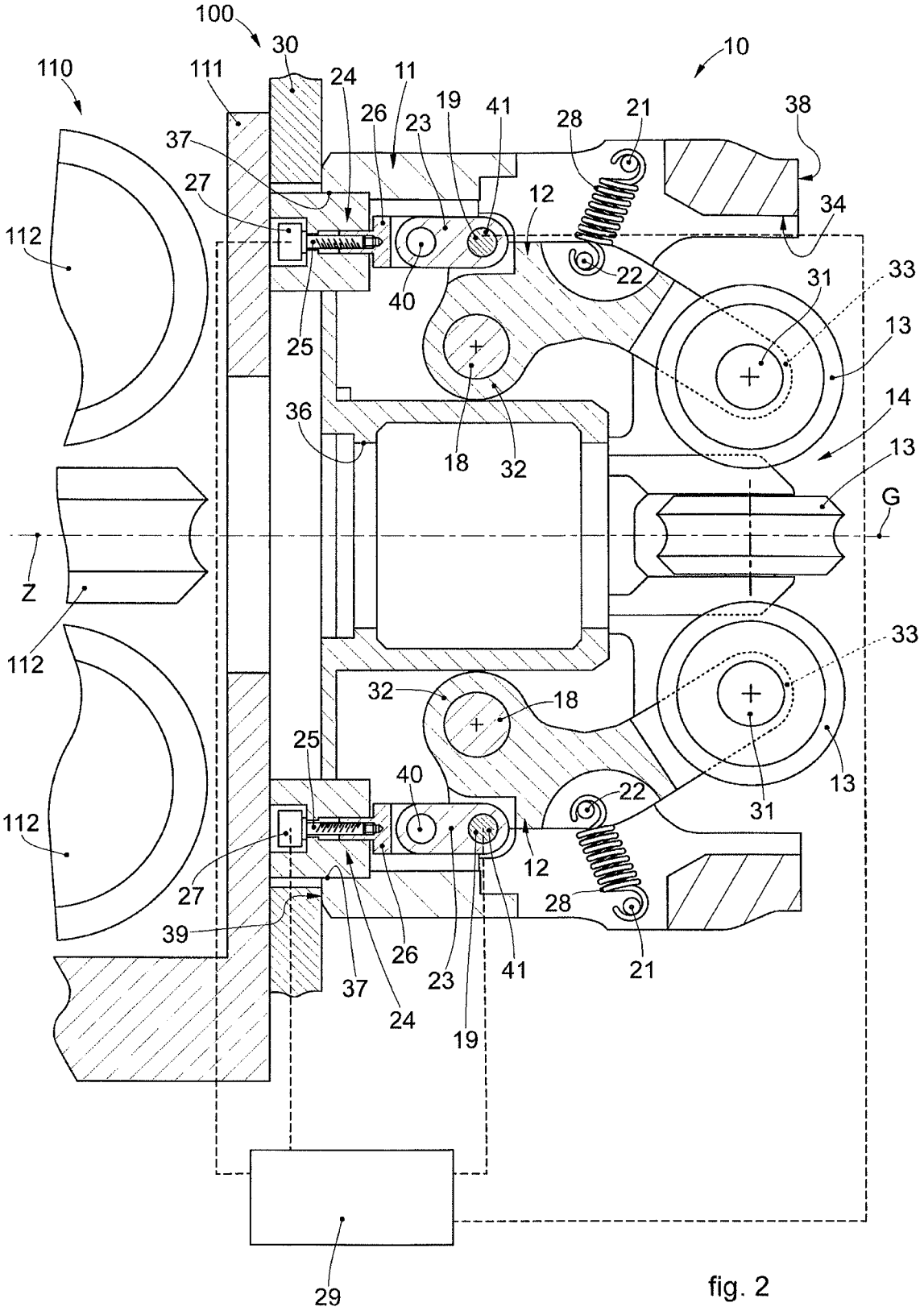
FIG. 2 shows the guide apparatus of FIG. 1 associated with a rolling apparatus, partly shown.

The guide rolls 13 can have a cylindrical conformation (FIG. 3), or be provided on their peripheral surface with a roller guide groove (FIGS. 1 and 2).

According to possible solutions, the guide apparatus 10 comprises at least three guide rolls 13, in this case four guide rolls 13 (FIGS. 1-3), angularly equidistant from each other and defining a roller guide gap 14 with a shape and size mating with that of the metal product that is made to transit. This solution allows to obtain an extremely precise and controlled containing and guide action on the metal product, which allows to obtain metal products with a high dimensional and geometric quality.

In fact, the presence of at least three guide rolls 13 allows to surround the metal products, preventing unwanted lateral displacements with respect to the roller guide axis G.

According to a possible solution, the at least three guide rolls 13 are installed on the respective support arms 12 all associated with the common support body 11. This allows to obtain a high control of the position of the guide rolls 13 and prevent the onset of mechanical plays that could take the metal product being processed out of tolerance.

According to a variant embodiment (FIG. 4), the guide apparatus 10 comprises two guide rolls 13 located adjacent to each other and having their own axes of rotation X parallel to each another.

According to another solution, the support body 11 is provided with a tubular cavity 34 through which the metal product is made to pass during use. The support body 11 can have a substantially discoidal shape, the cavity of which defines the tubular cavity 34.

The support arms 12 and the guide rolls 13 can be at least partly positioned in the tubular cavity 34.

Moreover, a through hole 36 can be made in the tubular cavity 34 through which the metal product is made to pass during use.

In accordance with possible solutions of the present invention, each guide roll 13 has its own axis of rotation X around which it rotates in an idle manner. The axes of rotation X of the guide rolls 13 can all be positioned on the same lying plane 7E. In this way it is possible to exert balanced guide actions on the plane orthogonal to the roller guide axis G. This prevents the metal product from being deflected during rolling.

Each guide roll 13 can be pivoted on one or two support arms 12 by means of a pin 31.

Figure 3:
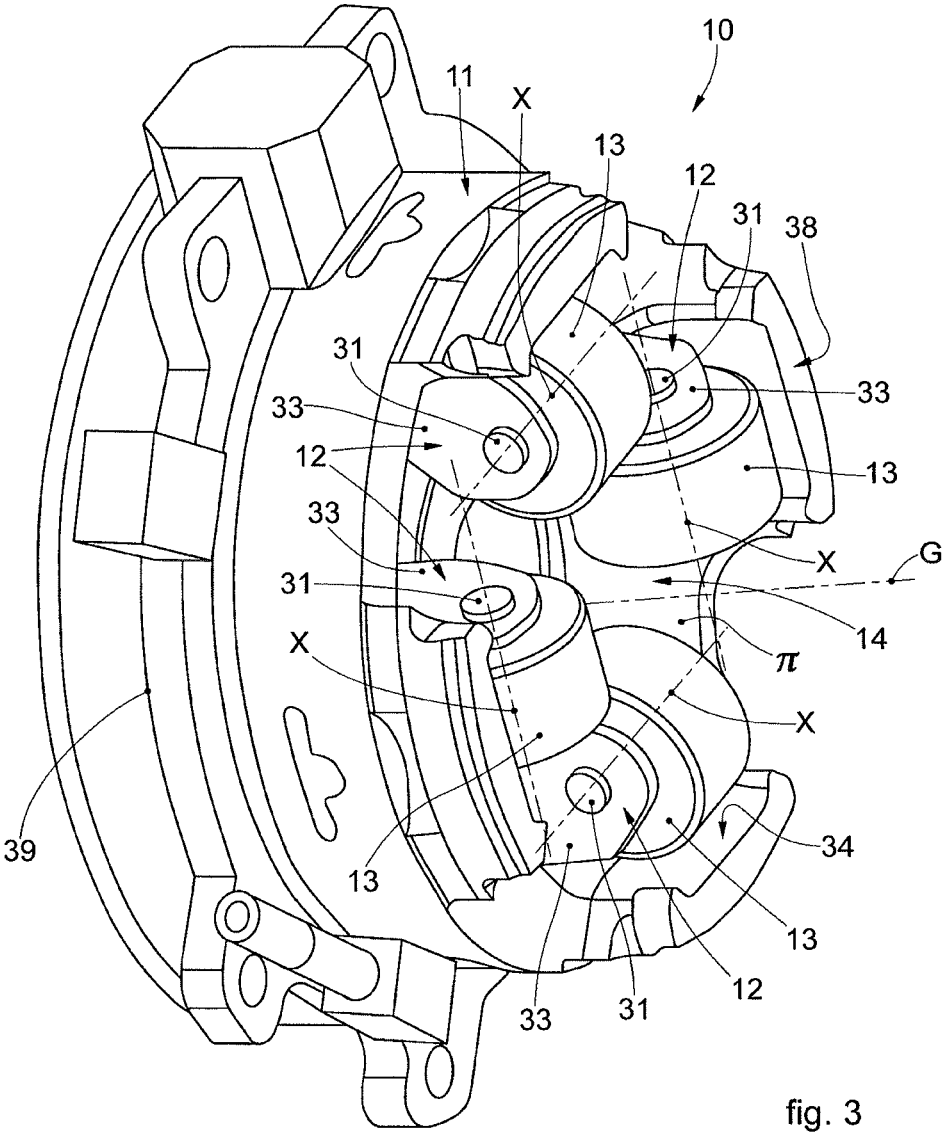
FIG. 3 is a perspective view of the guide apparatus of FIG. 1.

According to a possible solution shown in FIGS. 1-3, the support arms 12 are provided with a first end 32 pivoted to the support body 11 and a second end 33, opposite the first end 32, on which the guide roll 13 is installed.

According to a variant embodiment (FIG. 4), the support arms 12 can be pivoted in an intermediate zone of the length of the support arms 12, and can support the guide rolls 13 in correspondence with one of their ends.

According to another aspect of the present invention, the guide apparatus 10 comprises adjustment devices 24 each of which is associated with one of the support arms 12 and is provided to adjust, independently of each other, the position of the respective guide roll 13 with which they are associated. In other words, a respective adjustment device 24 is associated with each support arm 12.

In particular, the adjustment of the position of the guide rolls 13 can provide an adjustment of the distance of each guide roll 13 with respect to the roller guide axis G.

The adjustment devices 24 can be installed on the support body 11 and each connected with a respective support arm 12.

According to a variant embodiment (FIGS. 1-4), the adjustment devices 24 can be configured to make the support arms 12 rotate around the pivoting elements 18 of the support arms 12. This rotation defines a simultaneous movement of the guide rolls 13 toward/away from the roller guide axis G.

In accordance with another variant embodiment (FIG. 5), the adjustment devices 24 can be configured to move the support arms 12 along each sliding guide 42 and, therefore, to determine a movement of the guide rolls 13 closer to/away from the roller guide axis G.

The sliding guides 42 can be installed transversely to the roller guide axis G, so as to determine the action to adjust the roller guide gap 14.

According to a possible solution, shown for example in FIGS. 1 and 2, the adjustment devices 24 are at least partly installed in respective housing seatings 37 of the support body 11.

The housing seatings 37 can be provided in the second side 39 of the support body 11.

According to a possible solution, each adjustment device 24 can comprise at least one of either an articulated mechanism, an adjustment screw or a cam or an eccentric element.

In accordance with the solution shown in FIGS. 1-3, each adjustment device 24 comprises an adjustment screw 25 and a slider 26 installed on the support body 11, connected to the support am 12 and into which the adjustment screw 25 is screwed.

The adjustment screw 25 and the slider 26 can each be installed in one of the housing seatings 37 of the support body 11.

By screwing and unscrewing the adjustment screw 25 it is possible to move the slider 26 with respect to the support body 11 and determine a consequent adjustment of the position of the support arm 12.

According to a possible solution, the slider 26 can be moved in a direction substantially parallel to the roller guide axis G.

According to a possible solution, a connection rod 23 is provided to reciprocally connect the adjustment device 24 to the respective support arm 12.

The connection rod 23 can be pivoted with respective ends to the adjustment device 24 and to the support arm 12 by means of a first pivoting element 40 and a second pivoting element 41 respectively.

According to a possible solution, the connection rod 23 is pivoted, with the first pivoting element 40, to the slider 26.

When the adjustment screw 25 is screwed in, the connection rod 23 moves the support arm 12 to distance the respective guide roll 13 away from the roller guide axis G, whereas when the adjustment screw 25 is unscrewed, the connection rod 23 moves the support arm 12 to bring the respective guide roll 13 nearer to the roller guide axis G.

In accordance with the solutions shown in FIGS. 1-3, the connection rod 23 is connected to the support arm 12 in correspondence with an intermediate zone of the latter, comprised between the first end 32 and the second end 33.

Figure 4:
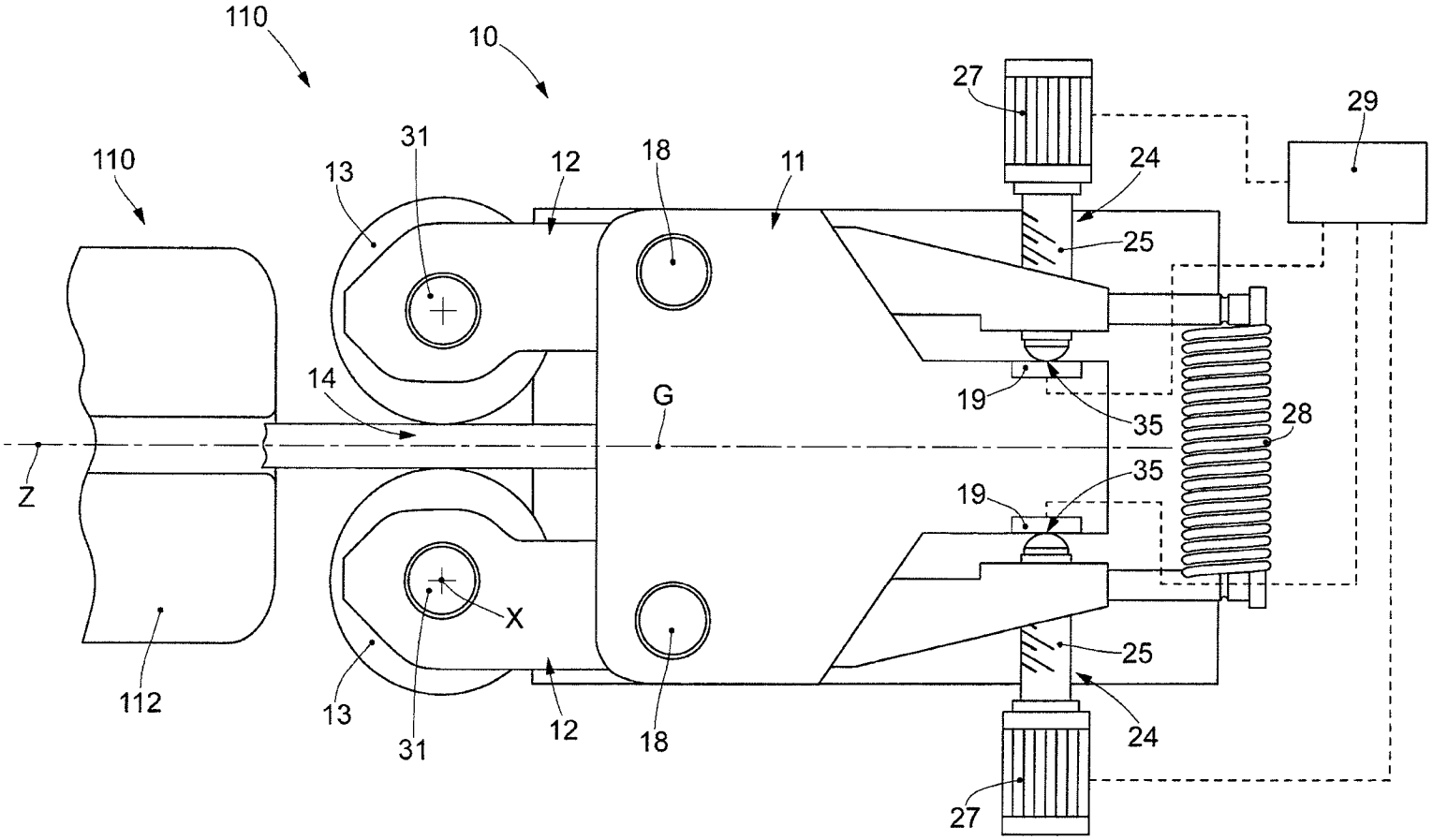
FIG. 4 is a view from above of a guide apparatus according to another embodiment.

According to another variant embodiment, shown by way of example in FIG. 4, each adjustment device 24 is associated with one end of the support arm 12, opposite the support end of the respective guide roll 13.

In accordance with this solution, each adjustment device 24 can act on the support arm 12 and on the support body 11 where it is installed.

According to the solution of FIG. 4, the adjustment screw 25 is screwed onto the corresponding support arm 12 and one of its ends abuts against the support body 11. By screwing or unscrewing the adjustment screw 25 it is possible to adjust the position of the respective support arm 12 and therefore of the guide roll 13 associated with it.

According to one aspect of the present invention, each adjustment device 24 comprises a drive member 27 provided to drive the respective adjustment device 24 and to adjust the position of each of the guide rolls 13.

Each drive member 27 can be integrated into the adjustment devices 24, or be connected thereto.

In accordance with a possible solution, the drive members 27 can comprise a linear actuator.

In accordance with another solution, the drive members 27 can comprise a rotary motor.

The drive members 27 can be the electric type. This allows to accurately adjust the positioning of the adjustment devices 24.

The drive members 27 can each be installed in one of the housing seatings 37 of the support body 11.

According to another variant embodiment, shown by way of example in FIG. 5, the adjustment devices 24 can comprise a plurality of wedge-shaped elements 43 each associated with a respective support arm 12, and a command element 44 installed sliding on the wedge-shaped element 43 and the movement of which determines an adjustment of the position of the respective support arm 12 with respect to the roller guide axis G.

According to possible solutions, the wedge-shaped element 43 is provided with a surface 45 inclined with respect to the roller guide axis G. By way of example only, the inclined surface 45 can be inclined with respect to the roller guide axis G by an angle comprised between 5° and 80°, preferably between 30° and 60°.

Each inclined surface 45 can be defined by a sliding guide 46 on which the command element 44 is installed slidingly in a guided manner.

The drive member 27 is connected to the command element 44 and is provided to move, by sliding, the command element 44 along the wedge-shaped element 43.

The movement of the command element 44 along the wedge-shaped element 43 also determines a simultaneous movement of the respective support arm 12 along the respective sliding guide 42 of the support body 11 and therefore a simultaneous adjustment of the sizes of the passage gap 14. In accordance with the solution shown in FIG. 5, the drive member 27 can comprise a linear actuator 47 such as, by way of example only, a worm screw jack, a rack, or similar and comparable members.

According to one embodiment (FIGS. 1, 2 and 4), an elastic element 28 can be connected to each support arm 12, configured to exert on the support arm 12 an action of distancing the guide rolls 13 from the roller guide axis G.

The elastic element 28 therefore has the function of keeping the guide rolls 13 distanced from the metal product, when the latter is made to pass through the roller guide gap 14.

In accordance with a possible solution (FIGS. 1-3), the support body 11 and the support arms 12 are provided with first connection elements 21 and respectively with second connection elements 22, and each elastic element 28 is connected with one end thereof to the first connection element 21 and with a second end thereof to the second connection element 22.

The connection elements 21, 22 can comprise, by way of example only, pins or hooks in correspondence with which the elastic element 28 is attached.

In accordance with a possible variant embodiment, shown by way of example only in FIG. 4, both the support arms 12 are connected, in correspondence with their ends, by an elastic element 28 provided to keep both support arms 12 distanced from one another.

According to a possible solution, the guide apparatus 10 comprises detection devices 19 provided to detect the stresses induced by the metal product on each of the guide rolls 13.

The detection devices 19 can be chosen from a group comprising load cells, strain gauges, piezoelectric sensors, capacitive sensors, inductive sensors, proximity sensors, or similar and comparable sensors suitable for the purpose.

The detection devices 19 can each be associated with one of the support arms 12 to detect the stresses that are induced by the guide rolls 13 on the support arms 12.

According to a possible solution, the detection devices 19 comprise a traction load cell configured to detect the stresses induced by the support arms 12.

According to a first solution (FIG. 1), the detection devices 19 are installed in the connection zone of the elastic element 28 to the support arm 12 and/or to the support body 11. In particular, it can be provided that the detection devices 19 are installed on at least one of either the first connection element 21 or the second connection element 22. This solution is particularly advantageous in that it allows to make simple and rapid modifications even to already existing roller guide devices 10, to allow the implementation of the present invention.

In accordance with another solution (FIG. 2), the detection devices 19 are installed in a position comprised between the respective support arms 12 and the respective adjustment devices 24. By way of example only, it can be provided that the detection devices 19 are associated with the connection rod 23 provided between the adjustment devices 24 and the support arms 12. In particular, the detection devices 19 can be associated with at least one of either the first 40 or the second pivoting element 41.

According to a possible embodiment, described for example with reference to FIG. 5, each detection device 19 can be associated with at least one of either the command element 44, the wedge-shaped element 43, or the drive member 27.

According to another solution (FIG. 4), the detection devices 19 are installed on the support body 11 and the adjustment devices 24 have a portion 35 which selectively contacts the detection devices 19 to transmit the stresses from the metal product to the detection devices 19 through the adjustment devices 24. In particular, it can be provided that the adjustment screw 25 has the portion 35 positioned in contact with the detection devices 19.

According to a variant, not shown, the detection devices 19 can be associated with the pivoting elements 18 of the support arms 12 to the support body 11.

According to another aspect of the present invention, the guide apparatus 10 can comprise a control and command unit 29 connected to the detection devices 19 and to the drive members 27 and configured to command the drive of the drive members 27 as a function of the data detected by the detection devices 19. In particular, during use, the control and command unit 29 detects, through the detection devices 19, the data of stresses acting on the individual guide rolls 13.

If the control and command unit 29 identifies that one of the guide rolls 13 is more or less stressed with respect to the other guide rolls 13, it commands the actuation of the respective drive member 27 so that it intervenes on the adjustment device 24 and re-establishes a balanced condition between the stresses acting on all the guide rolls 13 of the guide apparatus 10.

In this way it is possible to make an automatic adjustment of the distance between the guide rolls 12 in order to compensate for any wear to which the latter are subjected during functioning, thus correcting any possible misalignments.

The control and command unit 29 can be a microcontroller, a microprocessor, a CPU, a programmable electronic board or suchlike.

FIG. 2 shows a possible implementation of the guide apparatus 10 connected to a rolling apparatus 110.

The guide apparatus 10 can be provided with a connection flange 30 configured to allow the connection of the guide apparatus 10 to a support structure 111 of the rolling apparatus 110.

The guide apparatus 10 is installed, with respect to the rolling apparatus 110, so that the rolling axis Z of the latter is aligned with the roller guide axis G of the guide apparatus 10.

The rolling axis Z is defined between rolling rolls 112 of the rolling apparatus 110.

Any possible misalignments between the roller guide axis G and the rolling axis Z can be corrected if necessary by acting on the drive members 27 by means of the control and command unit 29.

It is clear that modifications and/or additions of parts may be made to the guide apparatus 10 and corresponding method as described heretofore, without departing from the field and scope of the present invention.

It is also clear that, although the present invention has been described with reference to some specific examples, a person of skill in the art shall certainly be able to achieve many other equivalent forms of guide apparatus 10 and corresponding method, having the characteristics as set forth in the claims and hence all coming within the field of protection defined thereby.

In the following claims, the sole purpose of the references in brackets is to facilitate reading: they must not be considered as restrictive factors with regard to the field of protection claimed in the specific claims.

The invention claimed is:

1. Apparatus to guide a metal product, said apparatus comprising, a support body (11), a plurality of support arms (12) associated with said support body (11), and a plurality of guide rolls (13) installed rotating in an idle manner on said support arms (12) and defining between them a roller guide gap (14) for said metal product, wherein a respective adjustment device (24) is associated with each support arm (12) and configured to adjust, independently from the other adjustment devices (24), the position of each of said guide rolls (13), and wherein said apparatus comprises detection devices (19), each associated with one of said support arms (12), configured to detect the stresses induced by said metal product on each of said guide rolls (13), wherein each adjustment device (24) comprises its own drive member (27) selected between an electric rotary motor and an electric linear actuator to adjust the position of each of said guide rolls (13), and wherein said apparatus comprises a control and command unit (29) connected to said detection devices (19) and to said drive members (27), and configured to command the drive of the respective one of said drive members (27) as a function of data detected by said detection devices (19).

2. Apparatus as in claim 1, wherein said detection devices (19) are installed in a position comprised between the support arms (12) and the respective adjustment devices (24).

3. Apparatus as in claim 2, wherein said detection devices (19) are associated with a connection rod (23) provided between said adjustment devices (24) and said support arms (12).

4. Apparatus as in claim 1, wherein an elastic element (28) is connected to each support arm (12) and is configured to exert on the support arm (12) an action of distancing the guide rolls (13) from the roller guide axis (G) defined by them, wherein said detection devices (19) are installed in the connection zone of said elastic element (28) to said support arm (12) and/or to the support body (11).

5. Apparatus as in claim 1, wherein said detection devices (19) are installed on said support body (11) and said adjustment devices (24) have a portion (35) that selectively comes into contact with said detection devices (19) to transmit the stresses from said metal product to said detection devices (19) through said adjustment devices (24).

6. Apparatus as in claim 1, wherein said plurality of guide rolls comprises at least three guide rolls (13) angularly equidistant from each other and defining said roller guide gap (14) with a shape and sizes mating with those of the metal product that is made to transit.

7. Apparatus as in claim 1, wherein said support arms (12) are pivoted to said support body (11) by pivoting elements (18), wherein said adjustment devices (24) are configured to make said support arms (12) rotate around said pivoting elements (18) of said support arms (12).

8. Rolling machine comprising at least a rolling apparatus (110) and at least a guide apparatus (10) as in claim 1 and installed on said rolling apparatus (110).

9. Method to guide a metal product exiting from or entering into a rolling apparatus (110), which provides to make said metal product pass through a roller guide gap (24) defined by guide rolls (13) installed, rotating in idle manner, on support arms (12), said support arms (12) being associated with a support body (11), said method including adjusting the position of each of the guide rolls (13), independently from each other, with adjustment devices (24) each associated with one of the support arms (12) and detecting, with detection devices (19), each associated with one of the support arms (12), of the stresses induced by the metal product on the guide rolls (13), wherein each adjustment device is driven by its own drive member (27) selected between an electric rotary motor and an electric actuator to adjust the position of each of the guide rolls (13), said drive being commanded by a control and command unit (29) that detects the data from said detection devices (19) and commands the respective one of said drive members (27) as a function of said data.

* * * * *